US007775319B2

(12) United States Patent
Imanishi et al.

(10) Patent No.: US 7,775,319 B2
(45) Date of Patent: Aug. 17, 2010

(54) DIAPHRAGM FOR SPEAKER AND MANUFACTURING METHOD THEREFOR

(75) Inventors: Masao Imanishi, Shizuoka-Ken (JP); Yasutaka Nakamura, Shizuoka-Ken (JP)

(73) Assignee: Yamaha Corporation, Shizuoka-ken (JP)

( * ) Notice: Subject to any disclaimer, the term of this patent is extended or adjusted under 35 U.S.C. 154(b) by 102 days.

(21) Appl. No.: 11/767,249

(22) Filed: Jun. 22, 2007

(65) Prior Publication Data

US 2008/0006475 A1 Jan. 10, 2008

(30) Foreign Application Priority Data

Jul. 5, 2006 (JP) ..... 2006-185712

(51) Int. Cl.
*G10K 13/00* (2006.01)
*H04R 1/00* (2006.01)
*H04R 7/00* (2006.01)

(52) U.S. Cl. ..... 181/170; 181/164; 181/167; 181/169; 181/173; 381/431

(58) Field of Classification Search ..... 181/170, 181/169, 164, 167, 173; 381/431
See application file for complete search history.

(56) References Cited

U.S. PATENT DOCUMENTS

| | | | | |
|---|---|---|---|---|
| 1,917,013 | A * | 7/1933 | Bostwick | 181/164 |
| 4,100,992 | A * | 7/1978 | Rehde et al. | 181/166 |
| 4,674,592 | A * | 6/1987 | Aoki et al. | 181/170 |
| 4,699,242 | A * | 10/1987 | Ono | 181/170 |
| 5,256,837 | A * | 10/1993 | Pak | 181/164 |
| 5,274,199 | A * | 12/1993 | Uryu et al. | 181/169 |
| 5,329,072 | A * | 7/1994 | Kageyama et al. | 181/167 |
| 5,903,658 | A * | 5/1999 | Okazaki et al. | 381/428 |
| 2004/0129492 | A1* | 7/2004 | Bertagni et al. | 181/150 |
| 2004/0168851 | A1* | 9/2004 | Imamura et al. | 181/169 |
| 2009/0038878 | A1* | 2/2009 | Imamura et al. | 181/148 |

FOREIGN PATENT DOCUMENTS

| | | |
|---|---|---|
| JP | 01082896 | 3/1989 |
| JP | 05083791 | 4/1993 |
| JP | 05083792 | 4/1993 |
| JP | 06-178386 | 6/1994 |
| JP | 2004-254013 | 9/2004 |

OTHER PUBLICATIONS

Bending Wood, Ultimate Handyman http://web.archive.org/web/20060503202627/http//www.ultimatehandyman.co.uk/WOODWORKINGBENDING WOOD.htm. May 3, 2006.

* cited by examiner

*Primary Examiner*—Jeffrey Donels
*Assistant Examiner*—Christina Russell
(74) *Attorney, Agent, or Firm*—Dickstein Shapiro LLP

(57) ABSTRACT

A diaphragm for use in a speaker is manufactured using a plurality of thin wooden boards having flat rectangular shapes. The thin wooden boards are impregnated with a resin; then, a plurality of cutouts, which are elongated along wooden fiber directions or which are elongated in directions crossing wooden fiber directions, are formed in the thin wooden boards. Instead of the cutouts, it is possible to form a plurality of folded portions elongated in directions crossing wooden fiber directions. The thin wooden boards are integrally laminated together in such a way that the wooden fiber directions thereof mutually cross with a prescribed angle therebetween. The thin wooden boards integrally laminated together are subjected to thermal pressing so as to form a wooden vibrator serving as the diaphragm. Thus, it is possible to easily produce the diaphragm having a high strength and superior acoustic characteristics without causing defects.

6 Claims, 6 Drawing Sheets

DIAPHRAGM FOR SPEAKER AND MANUFACTURING METHOD THEREFOR

BACKGROUND OF THE INVENTION

1. Field of the Invention

The present invention relates to diaphragms for speakers and manufacturing methods therefor.

This application claims priority on Japanese Patent Application No. 2006-185712, the content of which is incorporated herein by reference.

2. Description of the Related Art

According to the conventionally-known manufacturing methods, thin wooden boards are subjected to press working or molding so as to produce diaphragms for use in speakers. Japanese Unexamined Patent Application Publication No. H06-178386 teaches that a single sheet of a thin wooden board is subjected to press working so as to produce a diaphragm, or plural sheets of thin wooden boards are laminated together and are then subjected to press working so as to produce a diaphragm. It also teaches that a thin wooden board is formed in a cone shape in advance and is then subjected to press working so as to produce a diaphragm.

Japanese Unexamined Patent Application Publication No. 2004-254013 teaches that a thin wooden board having a V-shaped cutout is prepared in advance; the thin wooden board is softened by way of the addition of water thereto; opposite sides along the V-shaped cutout are adhered together by way of primary pressing; the thin wooden board after the primary pressing is impregnated with a thermosetting resin; then, the thin wooden board impregnated with the thermosetting resin is subjected to secondary pressing so as to produce a diaphragm.

In general, thin wooden boards are easily broken or split along the grains thereof during press working or molding. For this reason, in the manufacturing method taught in Japanese Unexamined Patent Application Publication No. H06-178386, the thin wooden board is subjected to steaming prior to molding, or it is subjected to boiling using an alkali solution prior to molding, thus making the thin wooden board have flexibility, whereby it is possible to control the occurrence of cracks during the molding. It is necessary that the diaphragm formed by way of press working be subjected to treatment in order to improve the durability thereof. Therefore, a coat of urethane varnish is applied to the thin wooden board after press working. However, the aforementioned manufacturing method is complex because it needs various processes before or after the press working.

The manufacturing method taught in Japanese Unexamined Patent Application Publication No. 2004-254013 is also complex because it performs press working twice. Since the opposite sides of the V-shaped cutout of the thin wooden board are adhered together, directions of the grains greatly change at the boundary of the adhered portion. This causes irregularity in terms of directions of the grains in the diaphragm, which in turn degrades the acoustic characteristics of the diaphragm or which in turn causes cracks in the diaphragm along specific directions. In addition, the adhered portion is slightly increased in thickness compared with the thickness of the other portion of the diaphragm. That is, the diaphragm suffers from irregularity in terms of the thickness, which in turn degrades the acoustic characteristics thereof.

SUMMARY OF THE INVENTION

It is an object of the present invention to provide a diaphragm for use in a speaker, which is produced by way of a simple manufacturing method without causing defects during press working.

It is another object of the present invention to provide a diaphragm for use in a speaker, which is improved in strength and acoustic characteristics.

In a first aspect of the present invention, a diaphragm for use in a speaker includes a wooden vibrator that is formed using a plurality of thin wooden boards, which are impregnated with a resin and are integrally laminated together in a laminated structure having a curved shape, and a plurality of high density portions that are elongated in a radial direction from the center to the periphery of the wooden vibrator, wherein the wooden vibrator has a uniformly distributed thickness. Herein, the high density portion in a plan view is formed in a band-like shape, a wedge-like shape, or a sectorial shape; and the width of the high density portion in a plan view is gradually increased in the direction from the center to the periphery of the wooden vibrator.

In the above, the resin is selected from among an epoxy resin, urethane resin, polyester resin, and acrylic resin. The resin content of the wooden vibrator ranges from 10 weight-percent to 70 weight-percent. In addition, coloring such as dye or pigment is applied to the wooden vibrator as necessary. Furthermore, the thickness of the wooden vibrator ranges from 0.2 mm to 0.7 mm.

The wooden fiber directions of the thin wooden boards integrally laminated together mutually cross with prescribed angles therebetween. For example, the wooden fiber directions of three or more thin wooden boards respectively cross with the same angle therebetween. When N thin wooden boards (where "N" is an integer not less than two) are laminated together, the wooden fiber directions thereof respectively cross with an angle of 360/2N degrees therebetween.

As described above, since the wooden vibrator forming the diaphragm has the uniformly distributed thickness irrespective of the formation of the high density portions, it is possible to improve the acoustic characteristics. The wooden vibrator is reinforced by means of the high density portions and is thus increased in the mechanical strength thereof; hence, it is possible to increase the degree of freedom in design. Since the rigidity of the wooden vibrator is increased by means of the high density portions, it is possible to improve the durability of the diaphragm against high input signals. Since the thin wooden boards forming the wooden vibrator are impregnated with a resin, it is possible to increase the strength of the wooden vibrator and to avoid the degradation due to aging. Since the wooden fiber directions mutually cross with prescribed angles therebetween, it is possible to further increase the strength of the wooden vibrator.

In a second aspect of the present invention, a diaphragm for use in a speaker is manufactured by way of impregnating a plurality of thin wooden boards having flat rectangular shapes with a resin, forming a plurality of cutouts, which are elongated in directions along or crossing wooden fiber directions, in each of the thin wooden boards, integrally laminating the thin wooden boards together in such a way that the wooden fiber directions thereof cross each other, and performing thermal pressing on the thin wooden boards integrally laminated together so as to form a wooden vibrator serving as the diaphragm. Herein, the cutouts are each elongated in a direction from the periphery to the center of the thin wooden board. In addition, the thin wooden boards are subjected to thermal pressing after the opposite sides of the cutouts thereof are respectively connected together. Instead of the cutouts, it is possible to form a plurality of folded portions, which are elongated in directions along or crossing wooden fiber directions, in each of the thin wooden boards. Herein, the folded portions are each elongated in a direction from the periphery to the center of the thin wooden board. Furthermore, the thin wooden boards are integrally laminated together in such a way that the wooden fiber directions thereof lie along or mutually cross each other. Incidentally, the process for forming the cutouts or folded portions can be performed before the process for impregnating the thin wooden board with a resin solution.

According to the aforementioned manufacturing method, the thin wooden boards are impregnated with a resin in advance and are then subjected to thermal pressing. This causes the thin wooden boards to slip on each other during the thermal pressing; hence, it is possible to improve the formability of the wooden vibrator. Since the opposite sides of the cutouts are connected together during the thermal pressing, it is possible to easily form the high density portions, and it is possible to reduce the difference of thickness between the high density portions and the other portions; that is, it is possible to realize the diaphragm having a uniformly distributed thickness. When the cutouts are formed along the wooden fiber directions, it is possible to improve the strength of the diaphragm because the wooden fibers of the thin wooden boards are not broken by the cutouts. When the cutouts are formed in directions crossing the wooden fiber directions, the wooden fibers are partially broken so that the wooden fiber lengths are shortened, thus increasing the flexibility of the thin wooden boards. That is, it is possible to further improve the formability of the diaphragm. Since the thin wooden boards are increased in flexibility, it is possible to easily produce any types of diaphragms each having a relatively small radius of curvature. Since the cutouts are each formed in the direction from the periphery to the center of the thin wooden board, it is possible to form the high density portions elongated from the center of the wooden vibrator in a radial manner.

In addition, since the thermal pressing is performed after the opposite sides of the cutouts are connected together, it is possible to reliably form the high density portions. By connecting together the opposite sides of the cutouts, the thin wooden boards are each formed in a curved shape having a certain curvature. This greatly reduces the amount of deformation of the thin wooden boards during the thermal pressing; hence, it is possible to avoid the occurrence of cracks. Since the thin wooden boards are laminated together in such a way that the wooden fiber directions thereof cross each other, it is possible to further increase the strength of the diaphragm.

When, instead of the cutouts, the folded portions are formed in the thin wooden boards, it is possible to easily form the high density portions by way of thermal pressing. Since the folded portions are each formed in the direction from the periphery to the center of the thin wooden board, it is possible to form the high density portions elongated from the center of the wooden vibrator in a radial manner.

BRIEF DESCRIPTION OF THE DRAWINGS

These and other objects, aspects, and embodiments of the present invention will be described in more detail with reference to the following drawings, in which.

DESCRIPTION OF THE PREFERRED EMBODIMENT

The present invention will be described in further detail by way of examples with reference to the accompanying drawings, which are diagrammatically illustrated with sizes and dimensions not necessarily matching actual sizes and dimensions of products.

1. Diaphragm for Speaker

Figure 1:
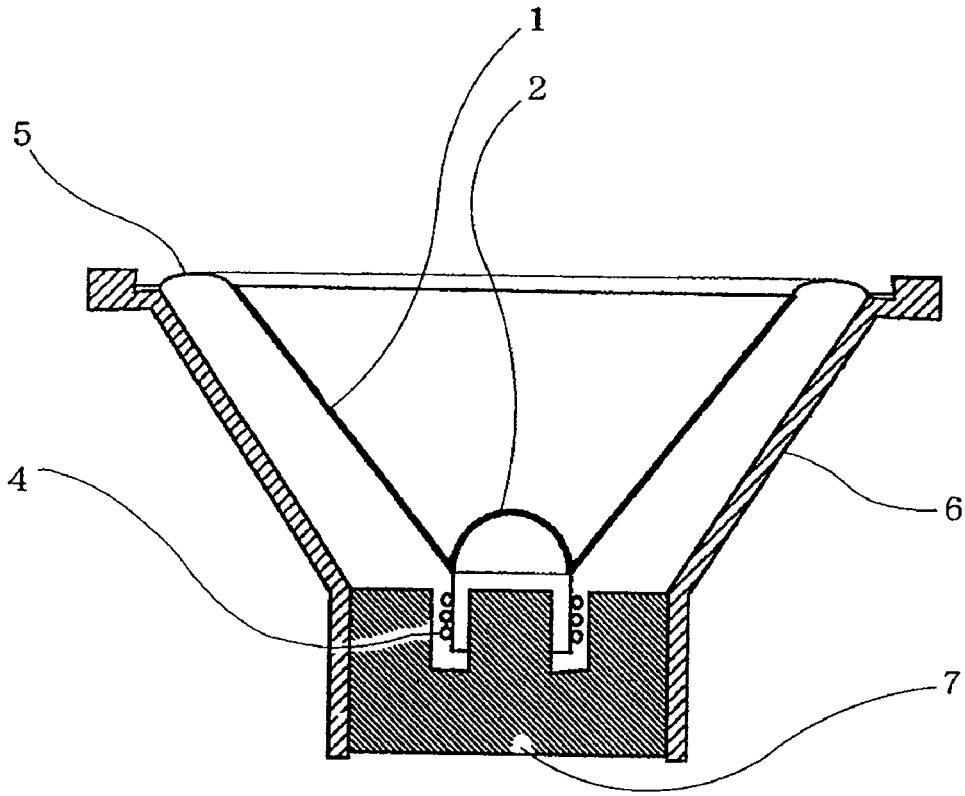
FIG. 1 is a cross-sectional view showing a speaker equipped with a diaphragm in accordance with a preferred embodiment of the present invention.
Figure 2:
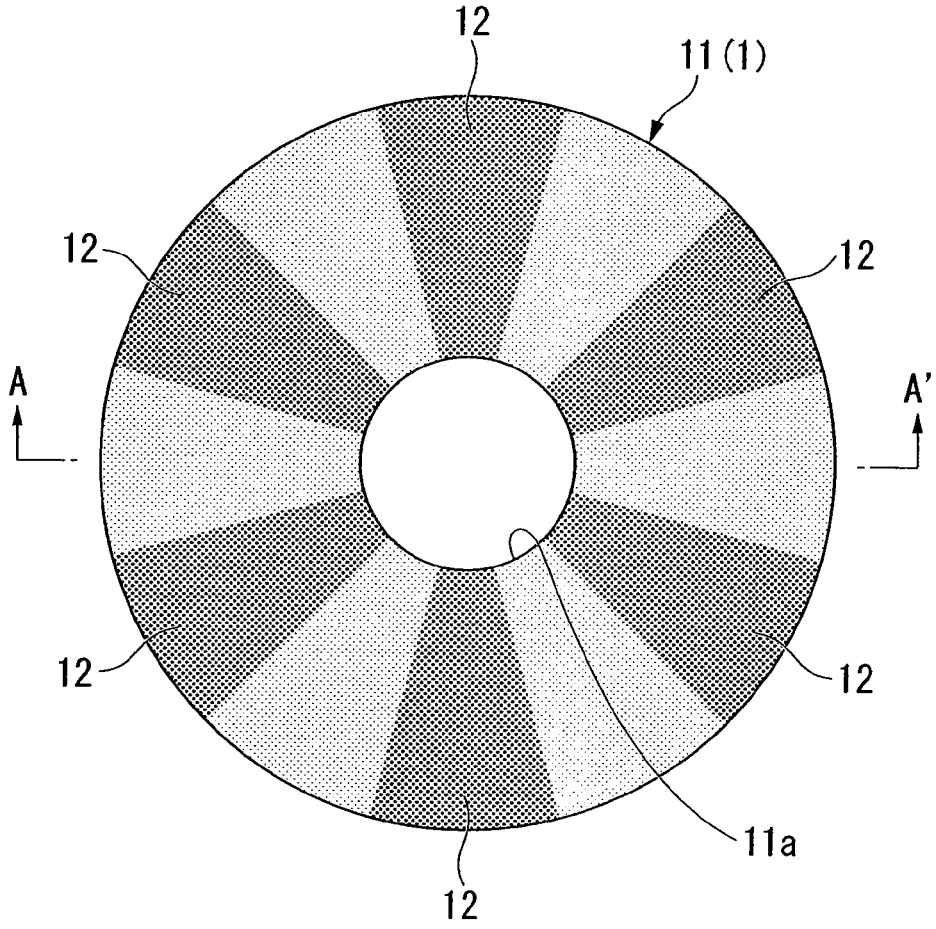
FIG. 2 is a plan view showing the diaphragm of the speaker.
Figure 3:
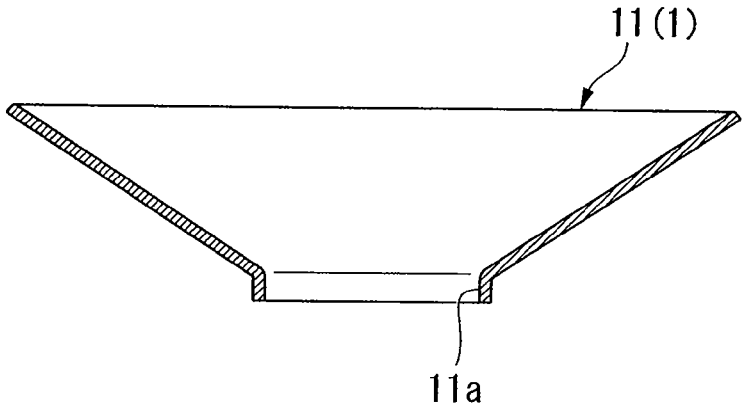
FIG. 3 is a cross-sectional view taken along line A-A in FIG. 2.

FIG. 1 is a cross-sectional view showing a speaker equipped with a diaphragm in accordance with a preferred embodiment of the present invention. FIG. 2 is a plan view showing the diaphragm of the speaker; and FIG. 3 is cross-sectional view taken along line A-A in FIG. 2.

The speaker shown in FIG. 1 includes a diaphragm 1, a center cap 2, a voice coil 4, a collar (or an edge member) 5, a frame 6, and a magnet 7.

The diaphragm 1 is composed of a wooden vibrator having a cone shape, which is enlarged in diameter externally, wherein the voice coil 4 is attached to a small-diameter end of the diaphragm 1, and a large-diameter periphery of the diaphragm 1 joins the frame 6 via the collar 5.

The center cap 2 is composed of a wooden vibrator having a semi-spherical shape that projects outwardly so as to cover the cylindrical portion (or a center pole) of the magnet 7 inserted into the voice coil 4 in a non-contact manner. The center cap 2 is attached to the small-diameter end of the diaphragm 1.

A damper (not shown) is additionally arranged between the small-diameter end of the diaphragm 1 and the frame 6 so as to prevent lateral vibration. A wiring of the voice coil 4 is extended toward a terminal (not shown) formed at the small-diameter end of the diaphragm 1; hence, the wiring of the voice coil 4 is extracted onto the frame 6 via the terminal.

In the speaker of FIG. 1, the diaphragm 1 is designed to convert a large part of vibration generated by the voice coil 4 into sound. The center cap 2 emits sound ranging from intermediate frequencies to high frequencies so as to improve frequency characteristics and sound emission characteristics of the speaker.

More specifically, as shown in FIG. 2, the diaphragm 1 is composed of a wooden vibrator 11, in which plural sheets of thin wooden boards impregnated with a resin are laminated together and are subjected to thermal pressing into a curved shape. In other words, the wooden vibrator 11 is composed of the resin and the wooden material forming thin wooden boards, which are formed in a curved shape.

It is possible to list various wooden materials for use in the formation of the thin wooden boards forming the wooden vibrator 11, such as birch, linden, beech, oak, cherry, spruce, maple, walnut, cedar, hinoki, red cedar, agatized wood, horse chestnut, elm, zelkova, and sapele. It is possible to list various resin materials impregnated into the thin wooden boards, such as an epoxy resin, urethane resin, polyester resin, and acrylic resin. Due to the resin impregnation, it is possible to improve the formability during the press working, and it is possible to avoid the degradation of the wooden vibrator 11.

It is preferable that the resin content of the wooden vibrator 11 range from 10 weight-percent to 70 weight-percent. When the resin content is above 10 weight-percent, it is possible to improve the formability and to avoid the degradation of the wooden vibrator 11. When the resin content is below 70 weight-percent, it is possible to improve the acoustic characteristics without causing a reduction of the content of the wooden material in the wooden vibrator 11.

A through-hole 11*a* is formed at the center of the wooden vibrator 11. The center cap 2 (see FIG. 1) is engaged with the through-hole 11*a* of the wooden vibrator 11. A plurality of high density portions 12 are formed and are elongated from the center to the periphery of the wooden vibrator 11 in a radial manner. The high density portions 12 are increased in the wooden density (i.e., the density of the wooden material forming the wooden vibrator 11) in comparison with the other portions of the wooden vibrator 11. It is preferable that the wooden density of the high density portions 12 be approximately 1.3 times higher than the wooden density of the other portions in the wooden vibrator 11.

It is preferable that the high density portion 12 in a plan view be formed in a band-like shape, a wedge-like shape, or a sectorial shape, for example. It is preferable that the width of the high density portion 12 in a plan view be gradually increased in a direction from the center to the periphery of the wooden vibrator 11. All of the high density portions 12 in a plan view can be formed in the same size; alternatively, the high density portions 12 can be formed in different sizes.

In FIG. 2, each of the high density portions 12 has a band-like shape whose width is gradually increased in the direction from the center to the periphery of the wooden vibrator 11. In other words, it has roughly a sectorial shape.

The high density portions 12 can be easily and visually distinguished from the other portions in plan view by horizontally viewing the wooden vibrator 11 that has deep-colored portions and light-colored portions; that is, the deep-colored portions of the wooden vibrator 11 can be visually recognized as the high density portions 12.

When the wooden vibrator 11 having the high density portions 12 is exposed to visible rays of light, it is possible to recognize the distinction between the prescribed portions having a relatively low light transmission ratio and the other portions having a relatively high light transmission ratio. That is, it is possible to recognize the prescribed portions having a relatively low light transmission ratio as the high density portions 12.

The wooden vibrator 11 having the high density portions 12 has a uniformly distributed thickness. In other words, the thickness of the high density portions 12 is substantially identical to the thickness of the other portions in the wooden vibrator 11. It is preferable that the thickness of the wooden vibrator 11 range from 0.2 mm to 0.7 mm. When the thickness is above 0.2 mm, it is unlikely to cause a reduction of the strength and rigidity of the wooden vibrator 11. When the thickness is below 0.7 mm, the rigidity is not increased so much; hence, it is possible to prevent the degradation of the acoustic characteristics.

It is possible for the wooden vibrator 11 to include coloring in addition to the resin. It is possible to use dye or pigment as the coloring.

It is preferable that the fiber directions of plural thin wooden boards laminated together be crossed with each other. For example, the fiber directions can be crossed with the same angle therebetween. Suppose that N thin wooden boards (where "N" is an integer not less than two) are laminated together. In this case, the fiber directions of the adjacently joined thin wooden boards are crossed with an angle of 360/2N degrees.

Due to the lamination of the thin wooden boards whose fiber directions cross each other, it is possible to improve the uniformity of vibration in the wooden vibrator 11; hence, it is possible to improve the acoustic characteristics. In addition, due to the mutually crossed fiber directions of the thin wooden boards, it is possible to further improve the mechanical strength of the wooden vibrator 11.

Due to the formation of the high density portions 12 in the wooden vibrator 11 adapted to the diaphragm 1, it is possible to realize fragmentarily different wooden densities in the wooden vibrator 11, which in turn realizes the distribution of natural resonance. Due to the distribution of natural resonance, it is unlikely to cause peaks in high-frequency ranges due to natural resonance; hence, it is possible to improve the acoustic characteristics.

In addition, the high density portions 12 reinforce the wooden vibrator 11, the mechanical strength of which is thus increased. Hence, it is possible to increase the degree of freedom in designing the diaphragm 1. Since the rigidity of the wooden vibrator 11 is increased by means of the high density portions 12, it is possible to reduce partial vibration, thus realizing relatively low distortion in sound. In addition, it is possible to improve the durability of the wooden vibrator 11 against high input signals.

Furthermore, since the wooden vibrator 11 has the uniformly distributed thickness irrespective of the formation of the high density portions 12, it is possible to design the speaker without consideration of detrimental effects regarding a limit to audio frequencies in the reproduction of high tone pitches.

Since the wooden vibrator 11 is composed of the thin wooden boards impregnated with the resin, it is possible to further increase the strength of the wooden vibrator 11 and to avoid degradation due to aging.

Since the fiber directions of the thin wooden boards forming the wooden vibrator 11 cross each other with prescribed angles therebetween, it is possible to further increase the strength of the wooden vibrator 11 adapted to the diaphragm 1.

2. First Manufacturing Method of Diaphragm

Next, a first manufacturing method of the diaphragm 1 will be described with reference to FIGS. 4A to 4D and FIGS. 5A and 5B.

Figure 4A:
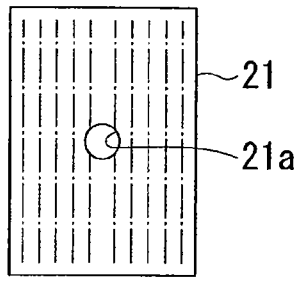
FIG. 4A is a plan view for explaining a first step of a first manufacturing method of the diaphragm.

As shown in FIG. 4A, there is provided a thin wooden board 21 having a flat rectangular shape in plan view, the thickness of which ranges from 0.1 mm to 0.5 mm. A through-hole 21*a* is formed at the center of the thin wooden board 21. Dashed lines indicate wooden fiber lines along which the grains are aligned.

Next, the thin wooden board 21 having the through-hole 21*a* is impregnated with a resin. For example, a resin is dissolved into a solvent so as to produce a resin solution, into which the thin wooden board 21 is soaked. Alternatively, the resin solution is sprayed or applied to the thin wooden board 21.

As the resin material, it is possible to list an epoxy resin, urethane resin, polyester resin, and acrylic resin. It is preferable that the resin content of the thin wooden board 21 range from 10 weight-percent to 70 weight-percent.

Figure 4B:
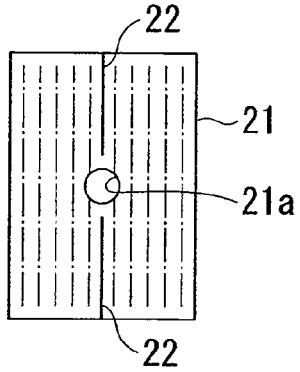
FIG. 4B is a plan view for explaining a second step of the first manufacturing method of the diaphragm.

Next, as shown in FIG. 4B, cutouts 22 are formed at prescribed positions along the wooden fiber directions of the thin wooden board 21. It is preferable that two cutouts 22 be formed in directions from the periphery to the center of the thin wooden board 21. It is preferable that the two cutouts 22 be formed symmetrically with each other in the thin wooden board 21.

Incidentally, the cutouts 22 can be formed in the thin wooden board 21 after the thin wooden board 21 is impregnated with the resin solution.

Figure 4C:
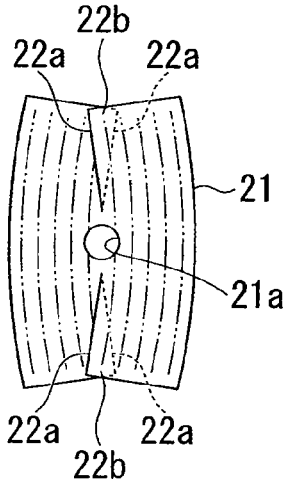
FIG. 4C is a plan view for explaining a third step of the first manufacturing method of the diaphragm.

Next, as shown in FIG. 4C, opposite sides 22*a* of the cutouts 22 are connected together so as to form connected portions 22*b*. In order to fix the connected portions 22*b*, the connected portions 22*b* can be subjected to thermal fusion; alternatively, the connected portions 22*b* can be fixed by use of a stapler (not shown), for example. Due to the formation of the connected portions 22*b*, the thin wooden board 21 is slightly bent about the through-hole 21*a* with a certain curvature.

Figure 4D:
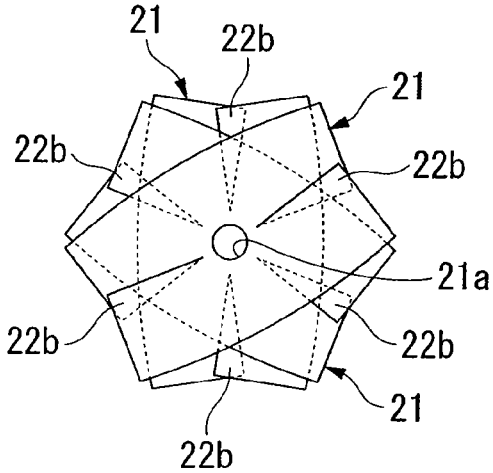
FIG. 4D is a plan view for explaining a fourth step of the first manufacturing method of the diaphragm.

There are provided three sheets of the thin wooden boards 21, each of which is produced by way of the steps shown in FIGS. 4A to 4C. The three sheets of the thin wooden boards 21 are laminated together as shown in FIG. 4D such that the through-holes 21*a* thereof are vertically overlapped with each other. In the case of FIG. 4D, the three sheets of the thin wooden boards 21 are laminated together such that the wooden fiber directions thereof are respectively crossed with an angle of 120° therebetween.

Figure 5A:
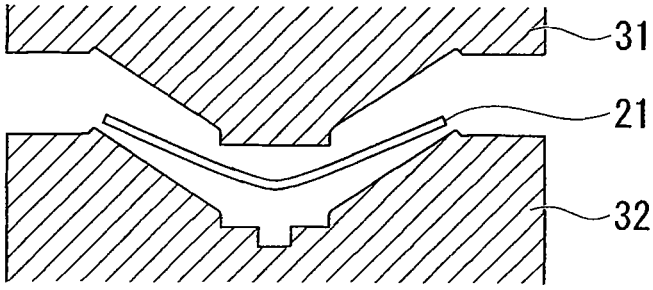
FIG. 5A is a cross-sectional view for explaining a fifth step of the first manufacturing method of the diaphragm.

Next, as shown in FIG. 5A, there are provided an upper mold 31 and a lower mold 32 having Nichrome wires (i.e., wires composed of nickel-chromium alloys). The three sheets of the thin wooden boards 21, which are laminated together as shown in FIG. 4D, are arranged between the upper mold 31 and the lower mold 32; then, the upper mold 31 and the lower mold 32 are heated by electrifying the Nichrome wires so that the three sheets of the thin wooden boards 21 are subjected to thermal pressing. The temperature of the upper mold 31 and the lower mold 32 depends upon the resin impregnated into the thin wooden boards 21, wherein, in the case of the epoxy resin, it is preferable that the temperature range from 100° C. to 150° C. In addition, it is preferable that the pressure applied to the thin wooden boards 21 sandwiched between the upper mold 31 and the lower mold 32 range from 0.1 Pa to 0.3 Pa. Herein, the heating temperature should not be increased over 150° C. because the thin wooden boards 21 are burnt and changed in color.

Figure 5B:
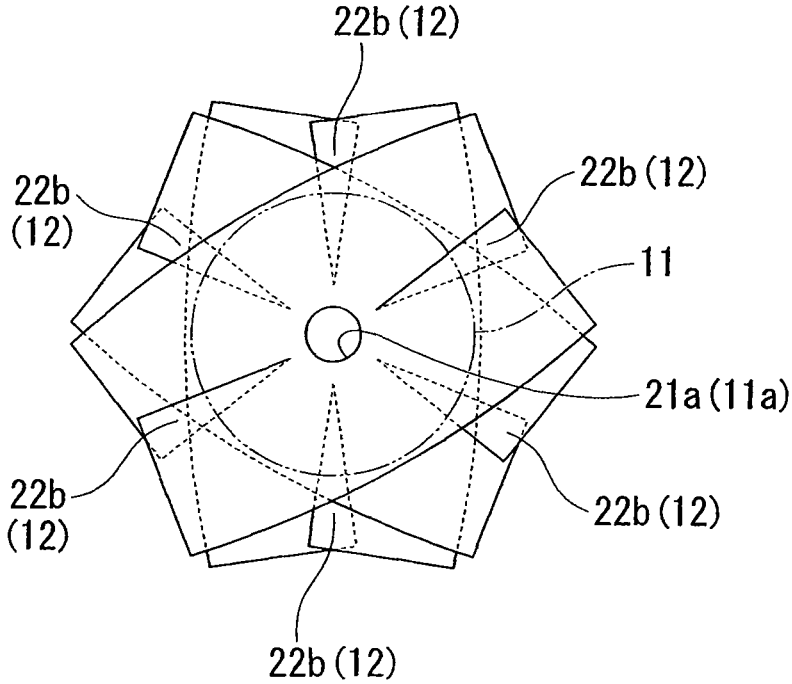
FIG. 5B is a plan view for explaining a sixth step of the first manufacturing method of the diaphragm.

By way of the thermal pressing, the three sheets of the thin wooden boards 21 are integrally laminated together so as to form a laminated structure. Then, the outer periphery of the laminated structure is partially cut out along the dashed lines in FIG. 5B. Thus, it is possible to produce the diaphragm 1 shown in FIGS. 2 and 3. Herein, the through-holes 21*a* of the thin wooden boards 21 laminated together correspond to the through-hole 11*a* of the wooden vibrator 11; and the connected portions 22*b* of the thin wooden boards 21 correspond to the high density portions 12. It is preferable that, during the cutting process of the outer periphery of the laminated structure, the prescribed portions, in which two or more sheets of the thin wooden boards 21 are laminated together, be left without being cut out. In the case of FIG. 5B, the prescribed portions of the laminated structure, in which the three sheets of the thin wooden boards 21 are laminated together, are left without being cut out.

According to the first manufacturing method of the diaphragm 1, the thin wooden boards 21 are impregnated with the resin in advance and are then laminated together and subjected to thermal pressing. This makes it possible for the prescribed portions of the thin wooden boards 21 laminated together to easily slip on each other; hence, it is possible to easily perform shaping of the thin wooden boards 21, which are tightly held between the upper mold 31 and the lower mold 32, without causing wrinkles or unwanted lines. That is, the first manufacturing method reliably improves the formability of the wooden vibrator 11.

The connected portions 22*b* of the thin wooden boards 11 laminated together correspond to the high density portions 12; hence, it is possible to form the high density portions 12 in a regular pattern.

Since the thin wooden boards 21 are easily subjected to shaping without forming wrinkles or lines, it is not possible to cause an irregular pattern of the high density portions 12, which may be caused due to the unwanted formation of wrinkles or lines. This makes it possible to produce the diaphragm 1 having superior acoustic characteristics.

Since the thin wooden boards 21 are subjected to thermal pressing after the opposite sides 22*a* of the cutouts 22 thereof are connected together, it is possible to reliably and precisely form the high density portions 12. Since the opposite sides 22*a* of the cutouts 22 are connected together, it is possible to form the thin wooden boards 21 having curved shapes, which in turn reduces the amount of deformation applied to the thin wooden boards 21 during the thermal pressing and which in turn prevents the occurrence of cracks.

Since the thin wooden boards 21 are subjected to thermal pressing after the opposite sides 22*a* of the cutouts 22 are connected together, it is possible to reduce the difference of thickness between the connected portions 22*b* (corresponding to the high density portions 12), at which the opposite sides 22*a* of the cutouts 22 of the thin wooden boards 21 are connected together, and the other portions; hence, it is possible to produce the diaphragm 1 having the uniformly distributed thickness.

Due to the formation of the plural cutouts 22 along the wooden fiber directions, it is possible to prevent the wooden fibers of the thin wooden boards 21 from being divided via the cutouts 22; hence, it is possible to improve the strength of the diaphragm 1.

Since the cutouts 22 are formed in directions from the center to the periphery of the thin wooden boards 21, it is possible to easily form the high density portions 12 extended in a radial direction.

Since the thin wooden boards 21 are laminated together in such a way that the wooden fiber directions thereof cross each other, it is possible to further improve the strength of the diaphragm 1.

In the first manufacturing method, the opposite sides 22*a* of the cutouts 22 are connected together; the cutouts 22 are fixed using the resin or stapler so as to form the connected portions 22*b*; then, the thin wooden boards 21 laminated together are subjected to thermal pressing. However, it is possible to perform thermal pressing without connecting the cutouts 22 of the thin wooden boards 21. In this case, when the thin wooden boards 21 laminated together are held between the upper mold 31 and the lower mold 32, the opposite sides 22*a* of the cutouts 22 are automatically connected together so as to appropriately and easily shape them without causing wrinkles or lines; hence, it is possible to form the laminated structure in which the thin wooden boards 21 are laminated together and in which the high density portions 12 are appropriately formed.

3. Second Manufacturing Method of Diaphragm

Next, a second manufacturing method of the diaphragm 1 will be described with reference to FIGS. 6A to 6D.

Figure 6A:
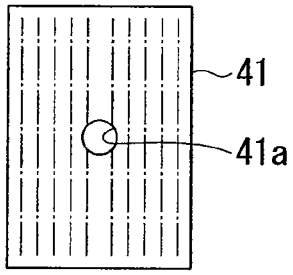
FIG. 6A is a plan view for explaining a first step of a second manufacturing method of the diaphragm.

As shown in FIG. 6A, there is provided a thin wooden board 41 having a flat rectangular shape in plan view, in which a circular through-hole 41*a* is formed at the center thereof. Similar to the thin wooden board 21 shown in FIG. 4A, the thin wooden board 41 has grains aligned along wooden fiber directions indicated by dashed lines in FIG. 6A. The thin wooden board 41 is impregnated with a resin.

Figure 6B:
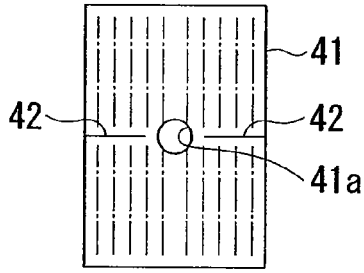
FIG. 6B is a plan view for explaining a second step of the second manufacturing method of the diaphragm.

Next, as shown in FIG. 6B, cutouts 42 are formed at prescribed positions of the thin wooden board 41 in such a way that they are elongated in directions crossing the wooden fiber directions. It is preferable that two cutouts 42 be formed and each be elongated in the direction from the periphery to the center of the thin wooden board 41. It is preferable that the two cutouts 42 be formed symmetrically with each other. Incidentally, the cutouts 42 can be formed in the thin wooden board 41 before the thin wooden board 41 is impregnated with the resin.

Figure 6C:
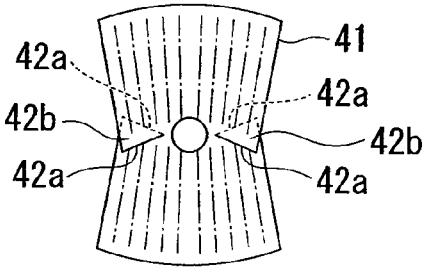
FIG. 6C is a plan view for explaining a third step of the second manufacturing method of the diaphragm.

Next, as shown in FIG. 6C, opposite sides 42*a* of the cutouts 42 are connected together so as to form connected portions 42*b*. The connected portions 42*b* can be fixed using a resin. Due to the formation of the connected portions 42*b*, the thin wooden board 41 is curved about the through-hole 41*a* with a certain curvature.

Figure 6D:
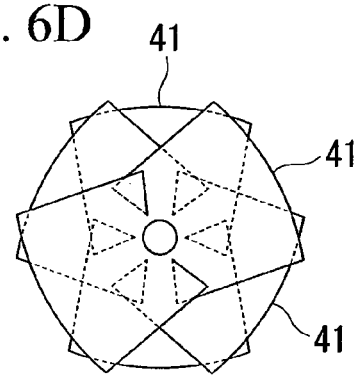
FIG. 6D is a plan view for explaining a fourth step of the second manufacturing method of the diaphragm.

There are provided three sheets of the thin wooden boards 41, each of which is produced by way of the aforementioned steps shown in FIGS. 6A to 6C. The three sheets of the thin wooden boards 41 are laminated together as shown in FIG. 6D such that the through-holes 41*a* thereof vertically overlap each other. Herein, the thin wooden boards 41 are mutually laminated together such that the wooden fiber directions thereof cross with an angle of 120° therebetween.

Thereafter, similar to the first manufacturing method, there are provided upper and lower molds having Nichrome wires (not shown), between which the three sheets of the thin wooden boards 41 laminated together are tightly held and are then subjected to thermal pressing. By way of the thermal pressing, the three sheets of the thin wooden boards 41 are integrally laminated together to form a laminated structure. Then, the outer periphery of the laminated structure is partially cut out, thus forming the diaphragm 1 as shown in FIGS. 2 and 3. Herein, the through-holes 41*a* of the thin wooden boards 41 correspond to the through-hole 11*a* of the wooden vibrator 11; and the connected portions 42*b* of the thin wooden boards 41 laminated together correspond to the high density portions 12.

According to the second manufacturing method of the diaphragm 1, it is possible to demonstrate the foregoing effects demonstrated by the first manufacturing method.

Figure 6E:
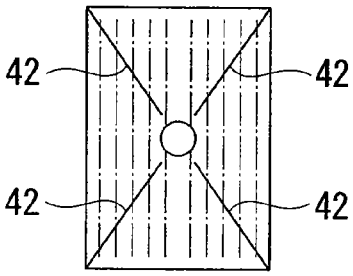
FIG. 6E is a plan view showing a variation of a thin wooden board having cutouts for use of the manufacturing of the diaphragm.

Specifically, due to the formation of the cutouts 42 along the directions crossing the wooden fiber directions of the thin wooden board 41, wooden fibers are partially broken by way of the cutouts 42 so that the wooden fiber length of the thin wooden board 41 is shortened so as to increase the flexibility of the thin wooden board 41. This makes it possible for the thin wooden board 41, which is tightly held between the upper and lower molds, to be easily shaped without forming wrinkles or lines during the thermal pressing. Due to the increased flexibility of the thin wooden board 41, it is possible to easily form the diaphragm 1 having a relatively small radius of curvature. Incidentally, the cutouts 42 can be formed in any directions crossing the wooden fiber directions of the thin wooden board 41. For example, as shown in FIG. 6E, it is possible to form four cutouts 42 elongated in directions inclining the wooden fiber directions with certain angles therebetween.

4. Third Manufacturing Method of Diaphragm

Next, a third manufacturing method of the diaphragm 1 will be described with reference to FIGS. 7A to 7D.

Similar to the first and second manufacturing methods, there is provided a thin wooden board 51 having a flat rectangular shape in plan view, in which a circular through-hole 51*a* is formed at the center thereof. The thin wooden board 51 has grains aligned in directions indicated by dashed lines in FIG. 7A. The thin wooden board 51 is impregnated with a resin.

Figure 7A:
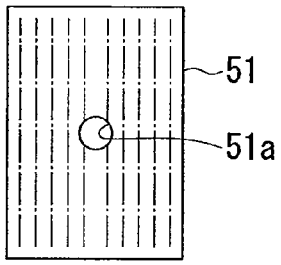
FIG. 7A is a plan view for explaining a first step of a third manufacturing method of the diaphragm.
Figure 7B:
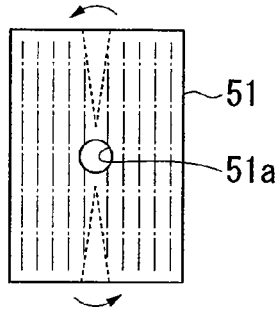
FIG. 7B is a plan view for explaining a second step of the third manufacturing method of the diaphragm.
Figure 7C:
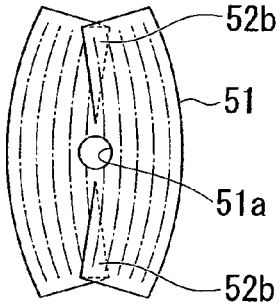
FIG. 7C is a plan view for explaining a third step of the third manufacturing method of the diaphragm.

Next, as shown in FIG. 7B, the thin wooden board 51 is partially folded along V-shaped fold lines (see dotted lines), thus forming folded portions 52*b* lying along wooden fiber directions as shown in FIG. 7C. It is preferable that the folded portions 52*b* be directed in a direction from the periphery to the center of the thin wooden board 51. It is preferable that a plurality of folded portions 52*b* be formed symmetrically with respect to the through-hole 51*a* serving as the center thereof. In order to fix the folded portions 52*b*, the folded portions 52*b* can be subjected to thermal fusion, or they can be fixed using a stapler (not shown). Due to the formation of the folded portions 52*b*, the thin wooden board 51 is slightly curved about the through-hole 51*a* with a certain curvature. Incidentally, the folded portions 52*b* of the thin wooden board 51 can be formed before the thin wooden board 51 is impregnated with a resin solution.

Figure 7D:
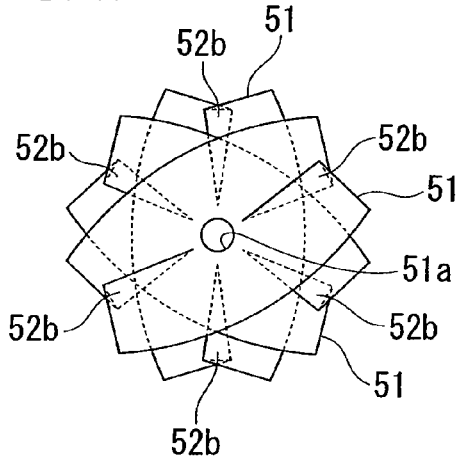
FIG. 7D is a plan view for explaining a fourth step of the third manufacturing method of the diaphragm.

Next, there are provided three sheets of the thin wooden boards 51, each of which is produced by way of the aforementioned steps shown in FIGS. 7A to 7C. The three sheets of the thin wooden boards 51 are laminated together as shown in FIG. 7D in such a way that the through-holes 51*a* thereof vertically overlap each other. That is, the three sheets of the thin wooden boards 51 are laminated together in such a way that the wooden fiber directions thereof cross with an angle of 120° therebetween.

Thereafter, similar to the first and second manufacturing methods, there are provided upper and lower molds having Nichrome wires, between which the three sheets of the thin wooden boards 51 laminated together are tightly held and are subjected to thermal pressing. By way of the thermal pressing, the three sheets of the thin wooden boards 51 are integrally laminated together so as to form a laminated structure. Then, the outer periphery of the laminated structure is partially cut out so as to produce the diaphragm 1 as shown in FIGS. 2 and 3. Herein, the through-holes 51*a* of the thin wooden boards 51 laminated together correspond to the through-hole 11*a* of the wooden vibrator 11; and the folded portions 52*b* of the thin wooden boards 51 laminated together correspond to the high density portions 12.

According to the third manufacturing method, it is possible to demonstrate the foregoing effects demonstrated by the first and second manufacturing methods. In addition, the third manufacturing method demonstrates the following effect.

That is, the third manufacturing method is characterized in that, instead of the cutouts, the folded portions 52*b* are formed in the thin wooden boards 51, which are then subjected to thermal pressing; hence, it is possible to easily form the high density portions 12. Since no cutout is formed in the thin wooden boards 51, the wooden fibers are not broken; hence, it is possible to further increase the strength of the diaphragm 1.

Figure 7E:
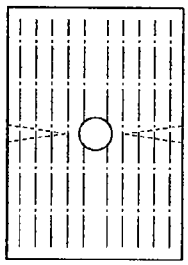
FIG. 7E is a plan view showing a variation of a thin wooden board having a plurality of folded portions for use in the manufacturing of the diaphragm.
Figure 7F:
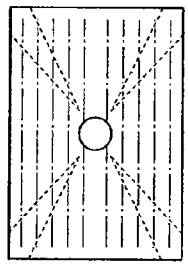
FIG. 7F is a plan view showing another variation of the thin wooden board having a plurality of folded portions for use in the manufacturing of the diaphragm.

Incidentally, it is not necessary to form the two folded portions 52*b* elongated along the wooden fiber directions as shown in FIGS. 7B and 7C. For example, as shown in FIG. 7E, two folded portions can be formed and elongated in directions crossing the wooden fiber directions. Alternatively, as shown in FIG. 7F, four folded portions can be formed and elongated in directions inclining the wooden fiber directions with certain angles therebetween.

Moreover, the number of thin wooden boards, which are laminated together and are subjected to thermal pressing, is not necessarily limited to three; that is, it is possible to use two thin wooden boards or to use four or more thin wooden boards. Herein, through-holes (e.g., through-holes 21*a*, 41*a*, and 51*a*) are not necessarily formed before the impregnation of the resin and can be formed after the thermal pressing.

Lastly, the present invention is not necessarily limited to the aforementioned embodiment and the aforementioned manufacturing methods; hence, it is possible to realize variations within the scope of the invention defined by the appended claims.

What is claimed is:

1. A manufacturing method of a diaphragm for use in a speaker, comprising the steps of:

impregnating a plurality of thin wooden boards having flat rectangular shapes with a resin;

forming a plurality of cutouts, which are elongated in directions along or crossing wooden fiber directions, in each of the plurality of thin wooden boards;

integrally laminating the plurality of thin wooden boards together in such a way that a plurality of high density portions are formed that are elongated in a radial direction from a center to a periphery of the diaphragm; and performing thermal pressing on the plurality of thin wooden boards integrally laminated together so as to form a wooden vibrator serving as the diaphragm.

2. The manufacturing method of the diaphragm for use in a speaker according to claim 1, wherein the plurality of cutouts are each elongated in a direction from a periphery to a center of the thin wooden board.

3. The manufacturing method of the diaphragm for use in a speaker according to claim 1, wherein the plurality of thin wooden boards are subjected to thermal pressing after opposite sides of the cutouts thereof are respectively connected together.

4. A manufacturing method of a diaphragm for use in a speaker, comprising the steps of:

impregnating a plurality of thin wooden boards having flat rectangular shapes with a resin;

forming a plurality of folded portions, which are elongated in directions along or crossing wooden fiber directions, in each of the plurality of thin wooden boards;

integrally laminating the plurality of thin wooden boards together in such a way that the wooden fiber directions thereof cross each other; and performing thermal pressing on the plurality of thin wooden boards integrally laminated together so as to form a wooden vibrator serving as the diaphragm.

5. The manufacturing method of the diaphragm for use in a speaker according to claim 4, wherein the plurality of folded portions are each elongated from a periphery to a center of the thin wooden board.

6. The manufacturing method of the diaphragm for use in a speaker according to claim 4, wherein the plurality of thin wooden boards are integrally laminated together in such a way that the wooden fiber directions thereof mutually cross each other.

* * * * *